US006682380B1

(12) United States Patent
Irwin et al.

(10) Patent No.: US 6,682,380 B1
(45) Date of Patent: Jan. 27, 2004

(54) MARINE ENGINE COOLING SYSTEMS AND METHODS

(75) Inventors: Gregory D. Irwin, Lindenhurst, IL (US); David F. Haman, Palm City, FL (US); Peter E. Lucier, Chicago, IL (US); Robert L. Bastrup, Salem, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/567,539

(22) Filed: May 5, 2000

(51) Int. Cl.[7] ..... B63H 21/10; F02B 75/18
(52) U.S. Cl. ..... 440/88 C; 123/41.74
(58) Field of Search ..... 440/88; 123/41.74, 123/41.08, 41.72

(56) References Cited

U.S. PATENT DOCUMENTS

| | | | | | |
|---|---|---|---|---|---|
| 4,082,068 | A | * | 4/1978 | Hale | 123/41.02 |
| 4,312,304 | A | * | 1/1982 | Tyner | 123/41.74 |
| 4,674,449 | A | * | 6/1987 | Hundertmark | 123/41.08 |
| 4,911,109 | A | * | 3/1990 | Kawamura et al. | 123/41.74 |
| 4,953,525 | A | * | 9/1990 | Sakurai et al. | 123/41.28 |
| 5,048,467 | A | * | 9/1991 | Kojima | 123/41.74 |
| 5,273,016 | A | * | 12/1993 | Gillespie et al. | 440/87 X |
| 5,381,763 | A | | 1/1995 | Niemchick | |
| 5,769,038 | A | * | 6/1998 | Takahashi et al. | 123/41.82 R |
| 5,893,783 | A | * | 4/1999 | Hiraoka et al. | 440/88 |
| 5,937,802 | A | * | 8/1999 | Bethel et al. | 123/41.74 |
| 6,093,067 | A | * | 7/2000 | Itoh et al. | 440/88 |
| 6,461,207 | B1 | * | 10/2002 | Nanami | 440/88 R |

* cited by examiner

*Primary Examiner*—S. Joseph Morano
*Assistant Examiner*—Andrew Wright

(74) *Attorney, Agent, or Firm*—Ziolkowski Patent Solutions Group, LLC

(57) ABSTRACT

The present invention, in one aspect, is a cooling system for a marine engine and includes cylinder cooling jackets, cylinder head cooling jackets, and thermostatic and pressure controls which facilitate safely operating the engine with low water flow rates. In one specific embodiment, the cooling system is employed in a marine engine including a V-type cylinder block with two cylinder banks and a valley between the banks. Each cylinder bank includes a plurality of cylinder bores (e.g., each cylinder bank includes three cylinder bores in a six cylinder engine), and respective exhaust ducts extend from and are in flow communication with each cylinder bore. Respective coolant flow paths extend from the valley to a section of each cylinder bore water jacket adjacent each cylinder exhaust duct. Specifically, water is provided from the valley to adjacent each exhaust duct in the cylinder banks. Each cylinder bore water jacket includes an outlet at an upper portion of each said cylinder bank. A water flow path extends from each cylinder bore water jacket outlet to a respective cylinder head water jacket. Variable thermostats are in flow communication with each cylinder bore water jacket, and each thermostat is in flow communication with a dump. Each flow path through the respective thermostats is in parallel with a respective cylinder head. The thermostats allow cooling of the cylinders to be thermostatically controlled. Specifically, the amount of water supplied to the cylinder head cooling jackets depends on the temperature condition at the thermostats. The cylinder head water jackets are in flow communication with a parallel connected blow off valve and thermostat. The blow off valve and thermostat are in flow communication with the water dump. When the blow off valve opens, maximum cooling is provided in that water flows unrestricted from the valley, to the cylinder cooling jackets, to the cylinder head cooling jackets, through the blow off valve to the dump.

40 Claims, 7 Drawing Sheets

MARINE ENGINE COOLING SYSTEMS AND METHODS

BACKGROUND OF THE INVENTION

This invention relates generally to marine engines and, more specifically, to cooling engine components during engine operation.

Marine engines typically include a cooling system for cooling at least portions of the engine exhaust system and the engine cylinders. For example, and in a known V-type marine engine, cooling water is supplied into a space between the cylinder banks, sometimes referred to herein as the engine valley. Water flows from the valley and to each cylinder bank. Specifically, a flow path is provided from the valley to each cylinder bank. The flow path to each cylinder bank does not, however, typically result in water flowing over the exhaust port of each cylinder, and water is not supplied directly to each cylinder from the valley. As a result, the hottest part of each cylinder (i.e., the exhaust port) is not directly cooled with the water, and the distribution of water to each cylinder bank and to each cylinder is not even. Therefore, an imbalance can result in the operation of each cylinder, and such imbalance can adversely impact engine operation.

In addition, and with at least some known marine engines, each cylinder bank includes a blow off valve and a thermostat connected in series in the flow path between the cylinder water jackets and the cylinder head water jackets. At lower speeds, there may not be sufficient pressure to open the blow off valve even though the thermostat may be fully open due to the engine temperature. Such an operating condition can lead to over heating the cylinder heads since only a small volume of water is supplied to the cylinder head.

Further, and since a blow off valve and a thermostat are provided for each cylinder bank, one cylinder bank may operate hot while the other bank is operating within a normal range. For example, if the thermostat of one cylinder bank fails in a closed condition, then very little water will be supplied to the cylinder head for that cylinder bank, and the cylinder head will be hot. The cylinder head for the other cylinder bank may, however, be within the normal temperature range.

BRIEF SUMMARY OF THE INVENTION

The present invention, in one aspect, is a cooling system for a marine engine and includes cylinder cooling jackets, cylinder head cooling jackets, and thermostatic and pressure controls which facilitate safely operating the engine with low water flow rates. In one specific embodiment, the cooling system has multiple failure modes so that even if one of the controls fails, the cooling system still provides sufficient cooling to facilitate avoiding severe damage to engine.

In an exemplary embodiment, the cooling system is employed in a marine engine including a V-type cylinder block with two cylinder banks and a valley between the banks. Each cylinder bank includes a plurality of cylinder bores (e.g., each cylinder bank includes three cylinder bores in a six cylinder engine), and respective exhaust ducts extend from and are in flow communication with each cylinder bore. The exhaust ducts are in flow communication with an engine exhaust housing.

Respective flow paths extend from the valley to a section of each cylinder bore water jacket adjacent each cylinder bore. Specifically, water is provided from the valley to the cylinder bore water jackets near each cylinder exhaust duct extending from each cylinder bore. For example, in a six cylinder engine, respective flow paths extend from the engine valley to each cylinder, i.e., six flow paths. By supplying cooling water from the valley to adjacent each cylinder exhaust duct, a hottest part of the engine is cooled by cooling water from the valley. Providing water from the valley to adjacent each cylinder exhaust duct facilitates uniform cooling of each cylinder and balanced operation of the engine.

Each cylinder bore water jacket includes an outlet at an upper portion of each said cylinder bank. A water flow path extends from each cylinder bore water jacket outlet to a respective cylinder head water jacket. A temperature sensor is thermally coupled to each cylinder head cooling jacket, and provides a signal representative of cylinder head temperature to an electronic control unit (ECU). In the event that the temperature at either cylinder head exceeds a pre-set temperature, ECU limits operation of engine, e.g., to below a pre-set rpm.

Also, variable thermostats are in flow communication with each cylinder bore water jacket, and each thermostat is in flow communication with a water dump passageway, or dump. Each flow path through the respective thermostats is in parallel with a respective cylinder head. Any suitable thermostatic valve which opens above a pre-determined temperature can be employed. The thermostats provide that cooling of the cylinders is thermostatically controlled.

The cylinder head water jackets are in flow communication with a parallel connected blow off valve and thermostat. The blow off valve and thermostat are in flow communication with the water dump. When the blow off valve opens, maximum cooling is provided in that water flows unrestricted from the valley, through the cylinder cooling jackets and the cylinder head cooling jackets, and through the blow off valve to the dump.

The cooling system has multiple failure modes which, in the event of failure of the one of the controls, facilitate avoiding severe damage to engine. For example, in the event one of the thermostats connected between the cylinder and dump fail, the thermostat connected in parallel with the blow-off valve still provides thermostatic control of flow through system. In addition, if all the thermostats fail, the blow-off valve still provides pressure control of flow through system. If the blow-off valve fails, then the thermostats still provide control of flow through system. Further, if the blow off valve fails open, coolant still flows through the engine although the engine may operate cold. While operating the engine cold may not provide optimum efficiency, operating the engine cold facilitates avoiding severe damage to the engine.

DETAILED DESCRIPTION OF THE INVENTION

The present invention is described herein in the context of an outboard engine. The present invention could, however, be utilized in connection with a stem drive engine as well as with an outboard engine. Further, the present invention is not limited to practice with any one particular engine, and therefore, the following description of an exemplary engine relates to only one exemplary implementation of the present invention.

Figure 1:
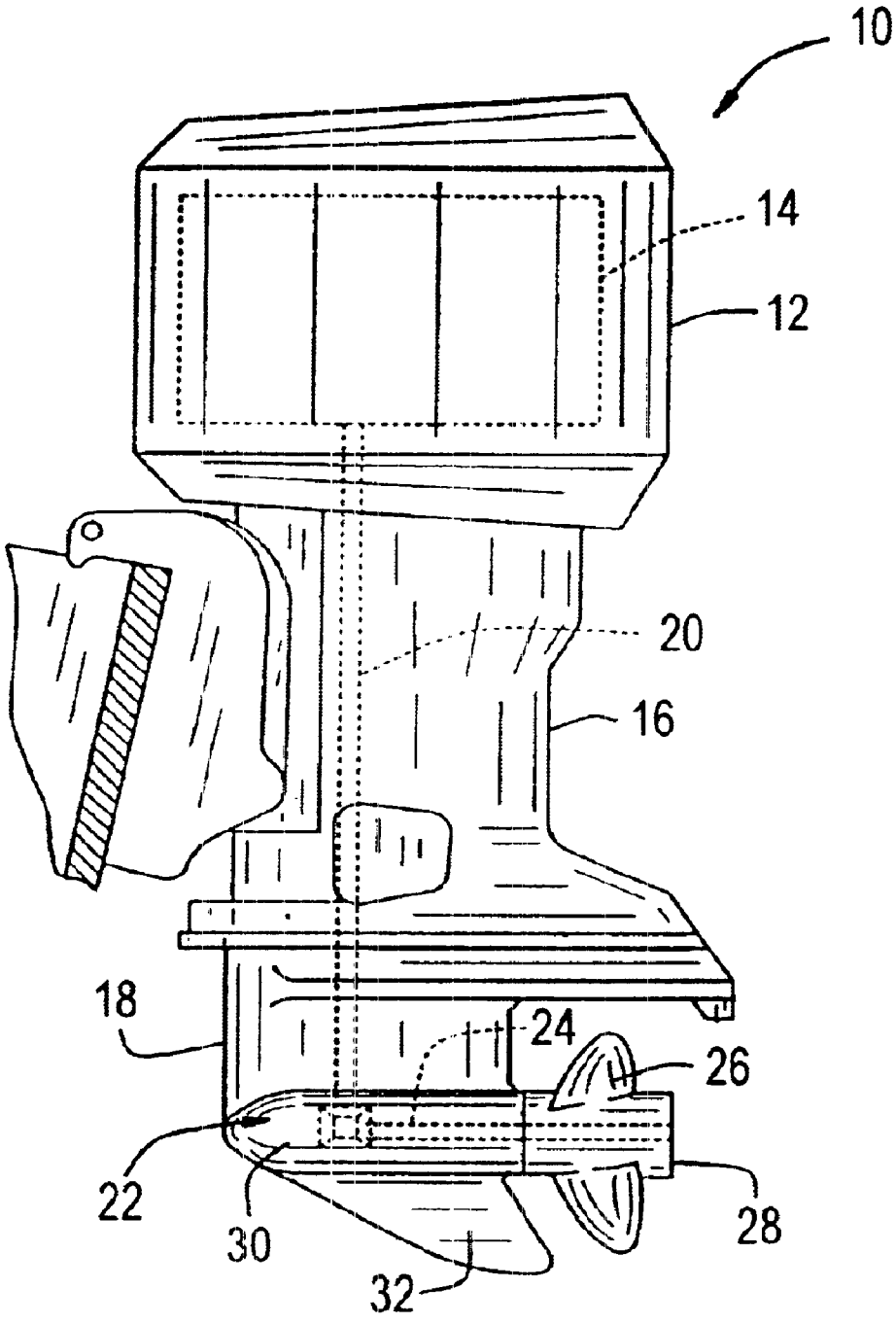
FIG. 1 is a perspective view of an outboard engine.

Referring more particularly to the drawings, FIG. 1 is a perspective view of an outboard engine 10, such as an outboard engine commercially available from Outboard Marine Corporation, Waukegan, Ill. Engine 10 includes a cover 12 which houses a power head 14, an exhaust housing 16, and a lower unit 18. A drive shaft 20 extends from power head 14, through exhaust housing 16, and into lower unit 18.

Lower unit 18 includes a gear case 22 which supports a propeller shaft 24. One end of propeller shaft 24 is engaged to drive shaft 20, and a propeller 26 is engaged to an opposing end of shaft 24. Propeller 26 includes an outer hub 28 through which exhaust gas is discharged. Gear case 22 includes a bullet, or torpedo, 30 and a skeg 32 which depends vertically downwardly from torpedo 30.

Figure 2:
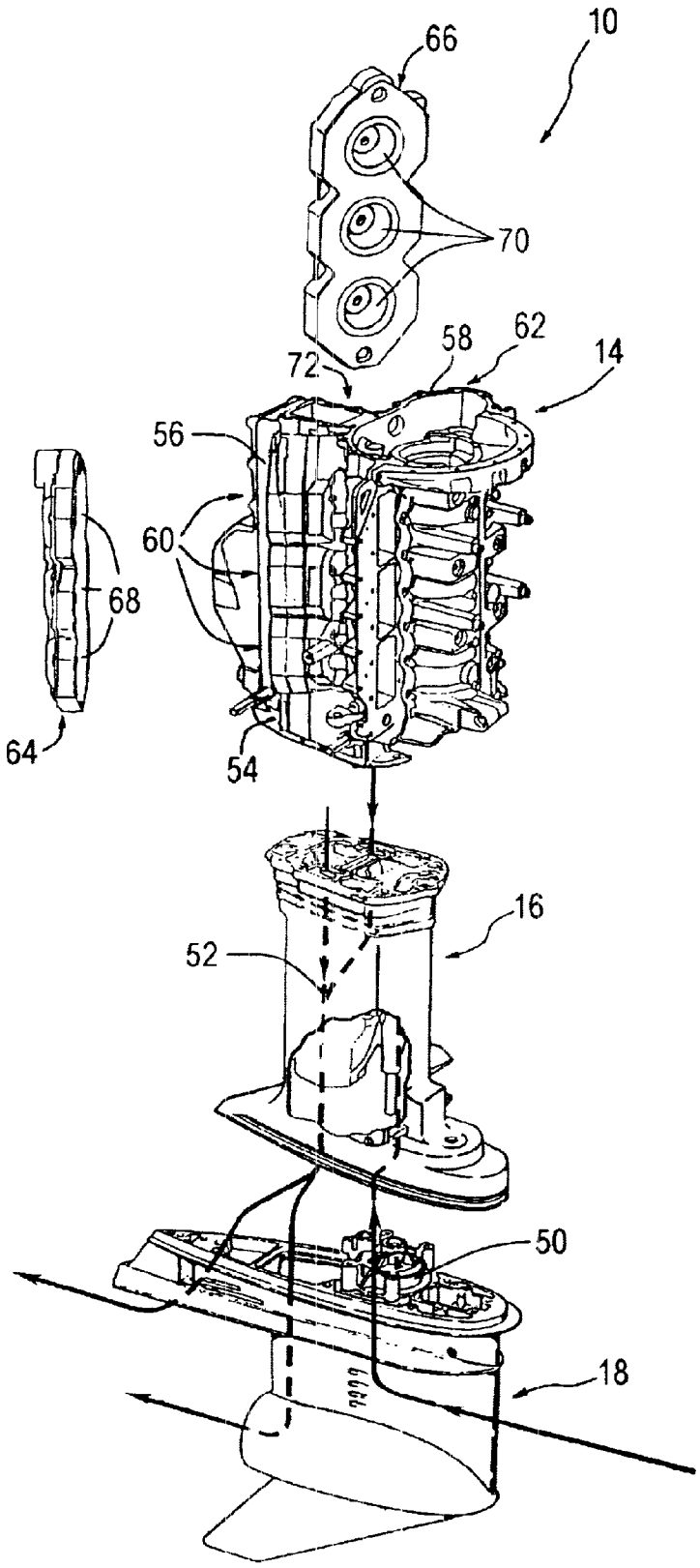
FIG. 2 is an exploded view of a portion of the engine shown in FIG. 1.

FIG. 2 is an exploded view of some components of engine 10. As shown in FIG. 2, power head 14, exhaust housing 16, and lower unit 18 couple together. The arrows in FIG. 2 indicate water flow paths through lower unit 18 and exhaust housing 16 to power head 14. Specifically, a water pump 50 draws water into lower unit 18 and pumps water through exhaust housing 16 into power head 14 to cool components of power head 14. The heated water then flows back through passages in exhaust housing 16 and is discharged from lower unit 18. Passages through which water is returned to the body of water are sometimes referred to herein as dump passages or a dump 52.

Power head 14 includes an engine block 54 having cylinder banks 56 and 58 defining a plurality of cylinders 60 and 62. Cylinder heads 64 and 66 engage to block 54. Each cylinder head 64 and 66 includes a series of combustion chamber recesses 68 and 70 respectively communicating with cylinders 60 and 62. Cylinder head cooling jackets formed in cylinder heads 64 and 66 provide cooling during engine operations. A gasket (not shown) can be located between a cylinder head surface and a surface of the associated cylinder bank. Power head 14 is a V-type in that power head 14 includes two cylinder banks 56 and 58 and a valley 72 between each cylinder bank 56 and 58.

Figure 3:
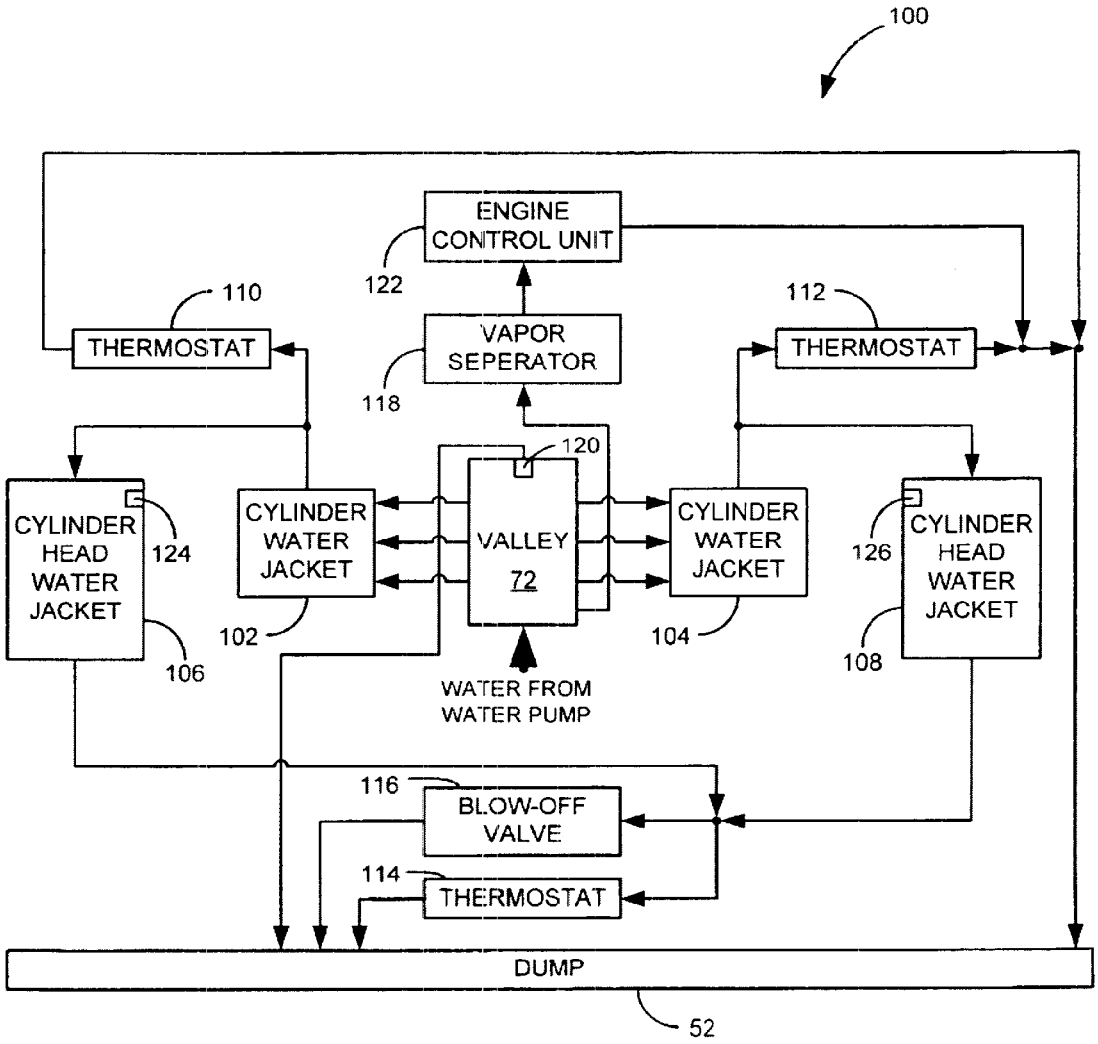
FIG. 3 is a schematic illustration of a cooling system in accordance with one embodiment of the present invention.

FIG. 3 is a schematic illustration of a cooling system 100 in accordance with one embodiment of the present invention. Cooling system 100 includes cylinder cooling jackets 102 and 104, cylinder head cooling jackets 106 and 108, and thermostatic and pressure controls 110, 112, 114 and 116 which facilitate safely operating the engine with low water flow rates. In addition, cooling system 100 has multiple failure modes so that even if one of controls 110, 112, 114, or 116 fails, cooling system 100 still provides sufficient cooling to facilitate avoiding severe damage to the engine.

As shown in FIG. 3, the engine includes valley 72 in flow communication with cylinder water jackets 102 which are integral with the engine block. In an exemplary embodiment, the engine is a six cylinder V-type engine. Of course, other engines (e.g., four cylinder or eight cylinder), including other engine types (e.g., an in-line engine), could utilize cooling system 100. Respective exhaust ducts are in flow communication with each cylinder bore, and the exhaust ducts are in flow communication with the engine exhaust housing.

Respective flow paths extend from valley 72 to a fuel vapor separator 118 via a vent 120 at an upper portion of valley 72 and to cylinder bore water jackets 102 and 104. Specifically, a flow path is provided from valley 72 to water cooled accessories such as to vapor separator 118 via vent 120, and cooling water flows from vapor separator 118 to an electronic control unit (ECU) 122. The water then flows from ECU 122 to dump 52. It should be understood that the cooling path for vapor separator 118 and ECU 122 is optional. That is, in some embodiments, there is no water cooling of vapor separator 118 or ECU 122, or both. In addition, cooling water can be provided to other water cooled accessories in addition to a fuel vapor separator and an ECU.

Respective flow paths also extend from valley 72 to a section of each cylinder bore water jacket 102 adjacent each cylinder bore. Specifically, water is provided from valley 72 to each water jacket 102 adjacent each cylinder exhaust duct extending from each cylinder bore. By supplying cooling water from valley 72 to adjacent each exhaust duct, a hottest part of the engine is cooled by cooling water from valley 72. Cooling the hottest part of the engine block (e.g., the engine block adjacent each cylinder exhaust port) with water directly from valley 72 facilitates requiring less water flow to cool the engine. Especially in view of the environment in which marine engines operate, e.g., sand and weeds that may inhibit the flow of cooling water into the engine cooling path, reducing the water flow required to cool the engine facilitates preventing damage to the engine. In addition, such cooling also facilitates maintaining the engine cylinders in a balanced condition throughout operation.

Each cylinder bore water jacket 102 and 104 includes an outlet at an upper portion of each cylinder bank. A flow path extends from each cylinder bore water jacket outlet to cylinder head water jackets 106 and 108. Temperature sensors 124 and 126 are thermally coupled to respective cylinder head water jackets 106 and 108 and provide a signal representative of cylinder head temperature to ECU 122. In the event that the temperature at either cylinder head exceeds a pre-set temperature, ECU 122 shuts down operation of the engine.

Also, variable thermostats 110 and 112 are in flow communication with each cylinder bore water jacket 102 and 104, and each thermostat 110 and 112 is in flow communication with dump 52. Each flow path through respective thermostat 110 and 112 is in parallel with respective cylinder head water jackets 106 and 108. Any suitable thermostatic valve which opens above a pre-determined temperature can be employed. Thermostats 110 and 112 provide that cooling of cylinders is thermostatically controlled. Specifically, the amount of water supplied to cylinder head cooling jackets 106 and 108 depends on the temperature condition at thermostats.

Variable thermostats 110 and 112 are temperature responsive and progressively close as engine speed increases so that as engine speed increases, an increasing amount of water flows through cylinder head cooling jackets 106 and 108. As a result, under idle condition, most of the coolant flows through thermostats 110 and 112 to dump 52. At increasing engine speeds above idle, increasing amounts of coolant flow through cylinder head cooling jackets 106 and 108.

Cylinder head water jackets 106 and 108 are in flow communication with parallel connected blow off valve 116 and thermostat 114. Blow off valve 116 and thermostat 114 are in flow communication with water dump 52. Any suitable variable thermostatic valve which opens above a predetermined temperature can be employed for thermostat 114, and any suitable pressure responsive valve which opens in response to pressure above a pre-determined pressure in the coolant can be employed for blow off valve 116. Blow off valve 116 may, for example, be a spring loaded check valve set to blow-off, or open, when the engine revolutions per minute (rpm) exceeds 1800 rpm.

When blow-off valve 116 opens, maximum cooling is provided by cooling system 100 in that water flows unrestricted from valley 72, to cylinder cooling jackets 102 and 104, to cylinder head cooling jackets 106 and 108, through blow off valve 116 , to dump 52. Flow passages in the engine are maximized so that blow off valve 116 and thermostat 114 are the only flow restrictors for the coolant.

In operation, water from the water pump is directed up through valley 72 of the engine block and into cylinder bore water jackets 102 and 104. At low engine speed and at low temperature, thermostatic valves 110 and 112 are open and water travels through valves 110 and 112 and is discharged into dump 52. When the speed of the engine rises above idle, thermostats 110 and 112 begin to close and an increasing amount of water flows through cylinder head cooling jackets 106 and 108. Thermostats 110, 112 and 114 control the flow through cylinder head cooling jackets 106 and 112. When the engine speed reaches a pre-set revolutions per minute, blow-off valve 116 opens (i.e., the water is sufficiently pressurized to open valve), and maximum flow occurs through cylinder head cooling jackets 106 and 108.

Cooling system 100 has multiple failure modes which, in the event of failure of the one of the controls, facilitate avoiding severe damage to the engine. For example, in the event one of thermostats 110 or 112 fail, thermostat 114 still provides thermostatic control of flow through system 100. In addition, if thermostat 114 fails, blow-off valve 116 still provides pressure control of flow through system 100. If blow-off valve 116 fails, then thermostats 110, 112 and 114 still provide control of flow through system 100. Further, if blow off valve 116 fails open, the coolant still flows through the engine although the engine operates cold. While operating the engine cold may not provide optimum efficiency, operating the engine cold facilitates avoiding severe damage to the engine. Also, in the event that the temperature sensed by either temperature sensor 124 and 126 exceeds a pre-set temperature, ECU 122 limits operation of engine to a pre-set rpm, e.g., 2000 rpm, to facilitate reducing the potential for damage to the engine.

Figure 4:
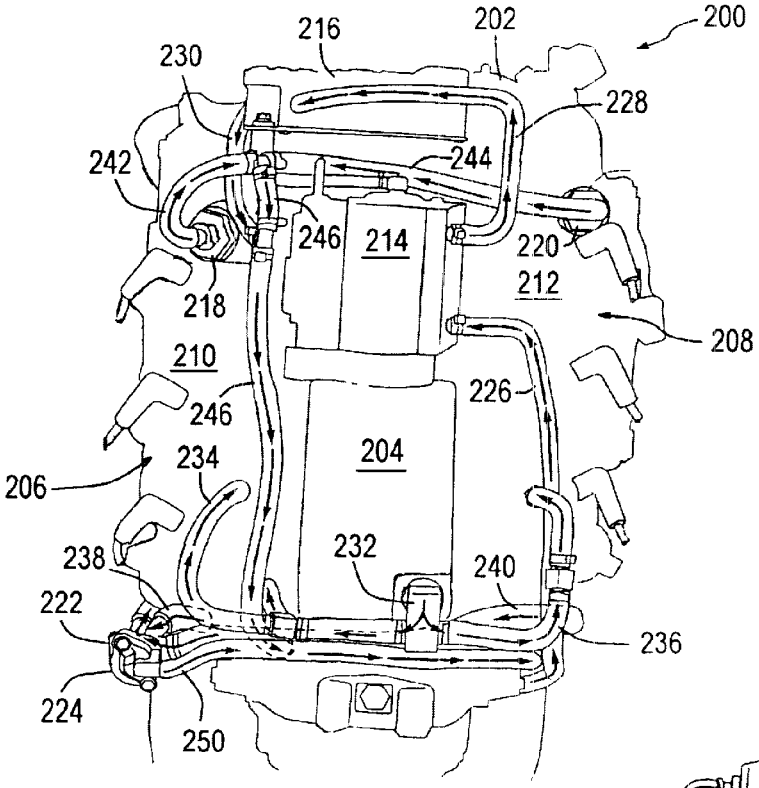
FIG. 4 is a rear view of an engine incorporating the cooling system shown in FIG. 3.
Figure 5:
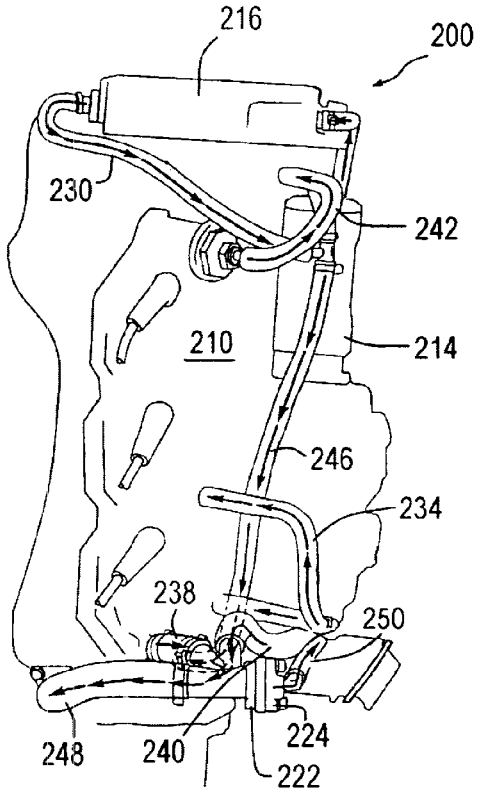
FIG. 5 is a port view of the engine shown in FIG. 4.
Figure 6:
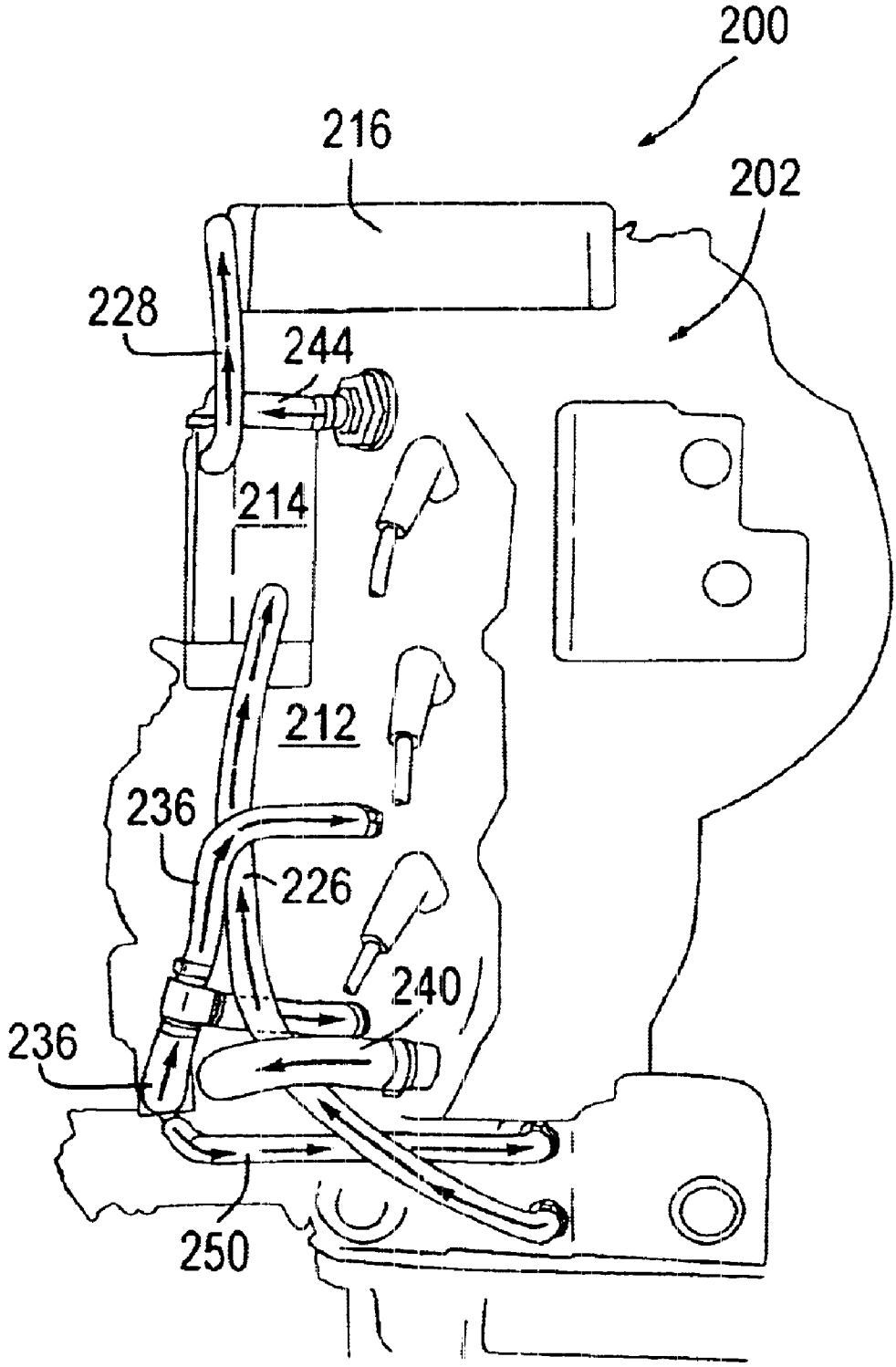
FIG. 6 is a starboard view of the engine shown in FIG. 4.

The specific implementation of cooling system 100 in specific engines varies depending on the particular engine. Cooling system 100 can be utilized in connection with many different engines and engine types. For example, the specific hose connections illustrated in FIGS. 4, 5, and 6 are exemplary only, and the present invention is not limited to the specific hose routing and connections illustrated therein. More specifically, FIG. 4 is a rear view of an engine 200 incorporating the cooling system shown in FIG. 3, and FIGS. 5 and 6 are port and starboard views, respectively, of engine 200.

More specifically, FIGS. 4, 5, and 6 illustrate hose routing for a six cylinder, V-type marine engine cooling system. Rather than the hoses illustrated in FIGS. 4, 5, and 6, the flow paths could be cast internal to the engine block.

Engine 200 includes block 202 having a valley 204 between respective cylinder banks 206 and 208, cylinder heads 210 and 212, a fuel vapor separator 214, and an engine control unit (ECU) 216. The cooling system includes thermostats 218 and 220 and parallel connected blow-off valve 222 and thermostat 224. The arrows shown in FIGS. 4, 5, and 6 indicate a direction of coolant flow through the respective hoses.

Specifically, a hose 226 extends from block 202 to vapor separator 214, and a hose 228 extends from vapor separator 214 to electronic control unit (ECU) 216. A hose 230 also extends from ECU 216 to the dump. Hoses 226 and 228 provide coolant from valley 204 to separator 214, and from separator 214 to ECU 216.

A hose 232 extends from block 202 and couples to hoses 234 and 236 in flow communication with respective cylinder heads 210 and 212. Hoses 238 and 240 couple respective cylinder heads 210 and 212 to the dump. Hoses 242 and 244 connect, via a drain tee 246, from respective thermostats 218 and 220 to a hose 246 coupled to the dump. Blow-off valve 222 is coupled, via a hose 248, to the dump. Thermostat 224 is coupled, via hose 250, to the dump.

Figure 7:
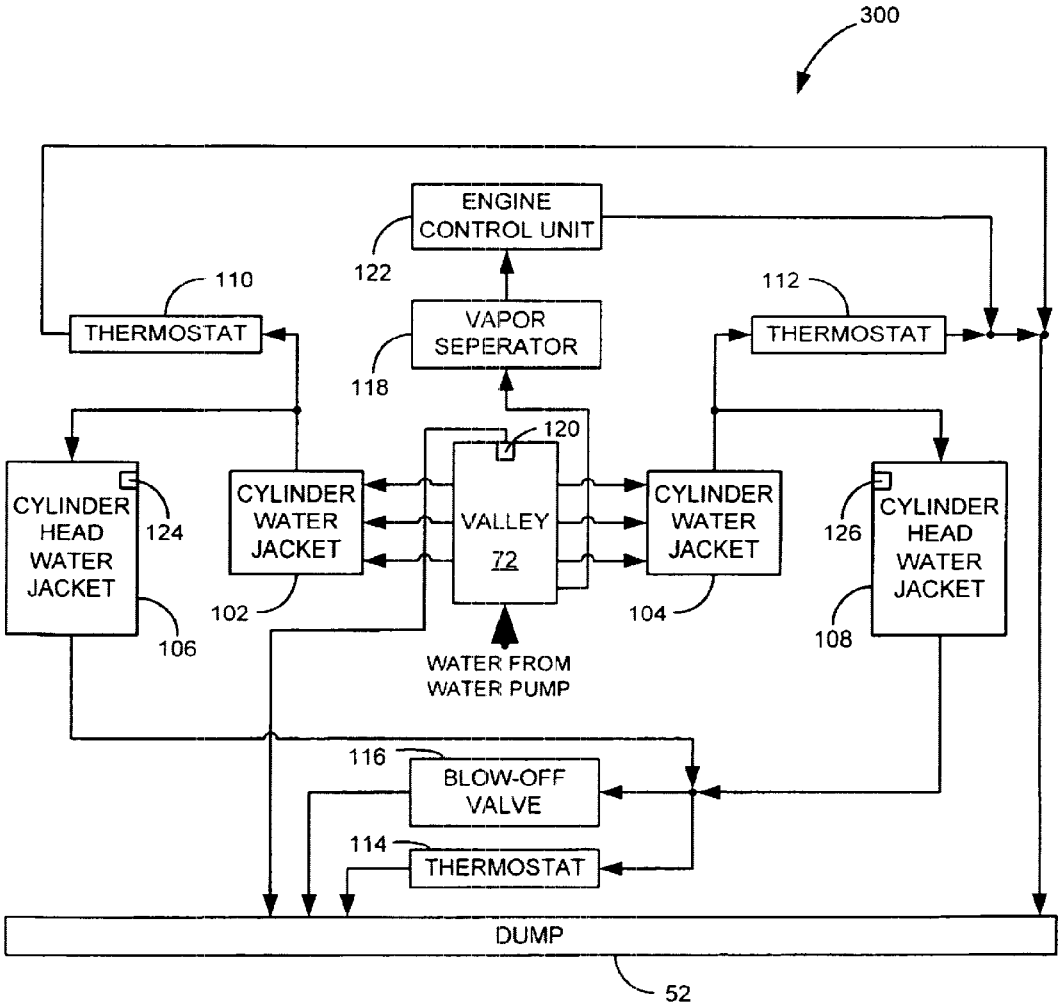
FIG. 7 is a schematic illustration of a cooling system in accordance with another embodiment of the present invention.

FIG. 7 is a schematic illustration of a cooling system 300 in accordance with another embodiment of the present invention. Components in FIG. 7 that are identical to components shown in cooling system 100 in FIG. 3 are referenced in FIG. 7 using the same reference numerals as used in FIG. 3. In system 300, coolant flows through vent 120 directly to dump 52, and coolant is supplied to fuel vapor separator 118 from a lower section of valley 72. In addition, coolant from thermostats 110 and 112, and ECU 122 is supplied to dump 52 via a common hose.

Figure 8:
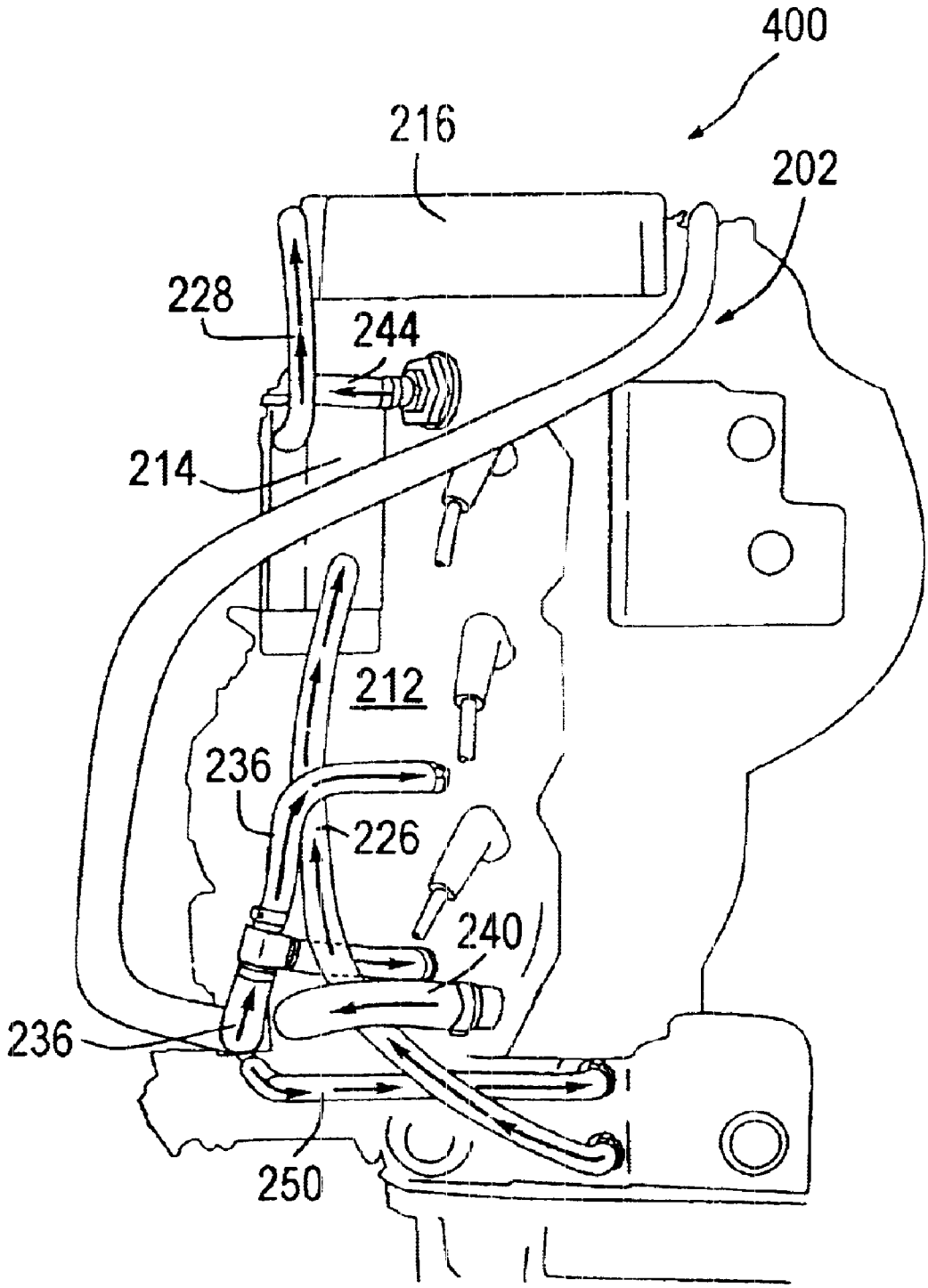
FIG. 8 is a starboard view of an engine incorporating the cooling system shown in FIG. 7.

FIG. 8 is a starboard view of an engine 400 incorporating cooling system 300. Components in FIG. 8 that are identical to components shown in FIG. 6 are referenced in FIG. 8 using the same reference numerals as used in FIG. 6. More specifically, FIG. 8 illustrates hose routing for a six cylinder, V-type marine engine cooling system. Rather than the hoses illustrated in FIG. 8, the flow paths could be cast internal to the engine block. Also, other hose connections as shown in FIGS. 4 and 5 would be employed in engine 400. Alternatively, and rather than the hoses, the flow paths could be cast internal to the engine block. Referring specifically to FIG. 8, a hose 402 is coupled to receive coolant flow from thermostats 218 and 220, and ECU 216, and is in flow communication with a dump.

While the invention has been described in terms of various specific embodiments, those skilled in the art will recognize that the invention can be practiced with modification within the spirit and scope of the claims.

What is claimed is:

1. A marine engine, comprising:

an engine block comprising a first cylinder bank and a second cylinder bank, said first and second cylinder banks in a V-configuration, a valley between said cylinder banks, each cylinder bank comprising at least one cylinder bore, respective exhaust ducts in flow communication with each said cylinder bore;

a first cylinder bore water jacket formed in said engine block, in flow communication with said valley, and adjacent to at least a portion of said block forming each said exhaust duct in said first cylinder bank;

a second cylinder bore water jacket formed in said engine block, in flow communication with said valley, and adjacent to at least a portion of said block forming each said exhaust duct in said second cylinder bank;

a first cylinder head water jacket in flow communication with said first cylinder bore water jacket;

a second cylinder head water jacket in flow communication with said second cylinder bore water jacket;

a water pump, said pump configured to supply a coolant to said valley such that coolant enters said first cylinder bore water jacket and said second cylinder bore water jacket from said valley;

a first thermostat downstream relative to the first cylinder bore water jacket and in parallel with at least the first cylinder head water jacket and a second thermostat downstream relative to the second cylinder bore water jacket and in parallel with at least the second cylinder head water jacket, the first and second thermostats configured to regulate the flow of coolant; and a third thermostat in fluid communication with the first and second cylinder head water jackets and configured to regulate flow theretrough.

2. A marine engine in accordance with claim 1 wherein each said cylinder bore water jacket comprises an outlet at an upper portion of each said cylinder bank.

3. A marine engine in accordance with claim 1 further comprising the first thermostat in flow communication with said first cylinder bore water jacket and the second thermostat in flow communication with said second cylinder bore water jacket.

4. A marine engine in accordance with claim 3 wherein said first and second thermostats are in flow communication with a water dump.

5. A marine engine in accordance with claim 3 wherein a first flow path from said first cylinder bore water jacket extends to said first thermostat, and a second flow path from said first cylinder bore water jacket extends to said first cylinder head water jacket.

6. A marine engine in accordance with claim 5 wherein a first flow path from said second cylinder bore water jacket extends to said second thermostat and a second flow path from said second cylinder bore water jacket extends to said second cylinder head water jacket.

7. A marine engine in accordance with claim 1 wherein said first cylinder head water jacket is in flow communication with a blow off valve and said third thermostat, and said blow off valve and said third thermostat are in flow communication with a water dump.

8. A marine engine in accordance with claim 7 wherein said second cylinder head water jacket is in flow communication with said blow off valve and said third thermostat.

9. A marine engine in accordance with claim 1 further comprising a vent in flow communication with said valley.

10. A marine engine in accordance with claim 9 wherein said vent is in flow communication with at least one of a vapor separator and an engine control unit.

11. A marine engine in accordance with claim 1 wherein the first and second cylinder banks contain a first and a second temperature sensor.

12. A marine engine in accordance with claim 11 wherein the first and second temperature sensor are in communication with an engine control unit.

13. An engine comprising:

a power head comprising an engine block, said engine block comprising a first cylinder bank and a second cylinder bank, said first and second cylinder banks in a V-configuration, a valley between said cylinder banks, each cylinder bank comprising at least one cylinder bore, respective exhaust ducts in flow communication with each said cylinder bore, a first cylinder bore water jacket in flow communication with said valley and adjacent to at least a portion of said block forming each said exhaust duct in said first cylinder bank, a second cylinder bore water jacket in flow communication with said valley and adjacent to at least a portion of said block forming each said exhaust duct in said second cylinder bank, a first cylinder head water jacket in flow communication with said first cylinder bore water jacket, and a second cylinder head water jacket in flow communication with said second cylinder bore water jacket;

a first and a second thermostat configured to regulate the flow of coolant in the first and the second cylinder head water jackets, the first and the second thermostats disposed downstream of the first and the second cylinder bore water jackets and in parallel with at least the first and the second cylinder head water jackets respectively;

a third thermostat disposed downstream of each cylinder head water jacket and configured to regulate flow of coolant to a dump;

an exhaust housing extending from said power head and in flow communication with said exhaust ducts; and a lower unit extending from said exhaust housing.

14. A marine engine in accordance with claim 13 wherein each said cylinder bore water jacket comprises an outlet at an upper portion of each said cylinder bank.

15. A marine engine in accordance with claim 13 further comprising the first thermostat in flow communication with said first cylinder bore water jacket, and the second thermostat in flow communication with said second cylinder bore water jacket.

16. A marine engine in accordance with claim 15 wherein said first and second thermostats are in flow communication with the water dump.

17. A marine engine in accordance with claim 15 wherein a first flow path from said first cylinder bore water jacket extends to said first thermostat and a second flow path from said first cylinder bore water jacket extends to said first cylinder head water jacket.

18. A marine engine in accordance with claim 17 wherein a first flow path from said second cylinder bore water jacket extends to said second thermostat, and a second flow path from said second cylinder bore water jacket extends to said second cylinder head water jacket.

19. A marine engine in accordance with claim 13 wherein said first cylinder head water jacket is in flow communication with a blow off valve and the third thermostat, and said blow off valve and said third thermostat are in flow communication with the water dump.

20. A marine engine in accordance with claim 19 wherein said second cylinder head water jacket is in flow communication with said blow off valve and said third thermostat.

21. A marine engine in accordance with claim 13 further comprising a vent in flow communication with said valley.

22. A marine engine in accordance with claim 21 wherein said vent is in flow communication with at least one of a vapor separator and an engine control unit.

23. A marine engine comprising:

an engine block comprising at least one cylinder bank, said cylinder bank comprising at least one cylinder bore, respective exhaust ducts in flow communication with each said cylinder bore, a cylinder bore water jacket comprising a flow path adjacent to at least a portion of said engine block forming each said exhaust duct and at least one temperature regulator located downstream of the cylinder bore water jacket and in parallel with a cylinder head water jacket; and an alternate flow path through a vapor sensor and an engine control unit upstream from the cylinder bore water jacket.

24. A marine engine in accordance with claim 23 wherein said engine block comprises an in-line type engine block.

25. A marine engine in accordance with claim 23 wherein said engine block comprises a V type engine block.

26. A marine engine in accordance with claim 23 wherein said cylinder bore water jacket comprises an outlet at an upper portion of said cylinder bank.

27. A marine engine in accordance with claim 23 wherein the at least one temperature regulator includes a thermostat in flow communication with said cylinder bore water jacket.

28. A marine engine in accordance with claim 27 wherein said thermostat is in flow communication with a water dump.

29. A marine engine in accordance with claim 27 wherein a first flow path from said cylinder bore water jacket extends to said thermostat.

30. A marine engine in accordance with claim 27 wherein a first flow path from said cylinder bore water jacket extends to said thermostat, and a second flow path from said cylinder bore water jacket extends to said cylinder head water jacket.

31. A marine engine in accordance with claim 23 further comprising a second cylinder head water jacket, said second cylinder head water jacket in flow communication with a second cylinder bore water jacket.

32. A marine engine in accordance with claim 23 further comprising a blow off valve and a thermostat, said blow off valve and said thermostat in flow communication with said cylinder head water jacket and a water dump.

33. A method for cooling a marine engine, the engine including an engine block having at least two cylinder banks with a plurality of cylinder bores therein, respective exhaust ducts extending from each cylinder bore, said method comprising the steps of:

supplying water from a valley between the at least two cylinder banks to a cylinder bore water jacket adjacent to at least a portion of the engine block forming each exhaust duct in each cylinder bank; and supplying the water from the cylinder bore water jacket to a cylinder head water jacket dependent on the position of a first thermostat downstream from the cylinder bore jacket and in parallel with the cylinder head water jacket and a second thermostat downstream of the cylinder head water jacket and in parallel with a pressure valve.

34. A method in accordance with claim 33 further comprising the step of supplying water from the cylinder head water jacket to the second thermostat.

35. A method in accordance with claim 34 wherein when the second thermostat is open, said method further comprises the step of supplying the water from the second thermostat to a water dump.

36. A method in accordance with claim 33 wherein the cylinder bore water jacket is in flow communication with the pressure valve and the pressure valve and the second thermostat are in flow communication with a water dump.

37. A marine engine comprising an engine block having at least two cylinder banks with a plurality of cylinder bores therein, respective exhaust ducts extending from each cylinder bore, said engine further comprising at least two cylinder heads having temperature indicators located therein, means for supplying water to a cylinder bore water jacket adjacent to at least a portion of said engine block forming each said exhaust duct, means for supplying water from the cylinder bore water jacket to a cylinder head water jacket, means for supplying water from said cylinder head water jacket to a thermostat, and means for allowing water to be supplied to the cylinder head water jacket, said means for allowing water to be supplied to the cylinder head water jacket being disposed downstream of the cylinder bore water jacket and in parallel with the cylinder head water jacket.

38. A marine engine in accordance with claim 37 wherein when said thermostat is open, water is supplied from said first thermostat to a water dump.

39. A marine engine in accordance with claim 37 wherein said cylinder bore water jacket is in flow communication with a blow off valve and said thermostat, and said blow off valve and said thermostat are in flow communication with a water dump.

40. A marine engine comprising an engine block having at least two cylinder banks with a plurality of cylinder bores therein, respective exhaust ducts extending from each cylinder bore, said engine further comprising at least two cylinder heads having temperature indicators located therein, means for supplying water to a cylinder bore water jacket adjacent to at least a portion of said engine block forming each said exhaust duct, means for supplying water from the cylinder bore water jacket to a cylinder head water jacket, and means for allowing water to be supplied to the cylinder head water jacket, said means for allowing water to be supplied to the cylinder head water jacket being disposed downstream of the cylinder bore water jacket and in parallel with the cylinder head water jacket and wherein the cylinder bore water jacket is in flow communication with a blow off valve and a thermostat wherein the blow off valve and the thermostat are in flow communication with a water dump.

* * * * *